US005410520A

United States Patent [19]

Stampfer

[11] Patent Number: 5,410,520

[45] Date of Patent: Apr. 25, 1995

[54] SPATIAL/DIGITAL TIMEPIECE

[76] Inventor: Noam R. Stampfer, 7135 SW. 34th Ave., Portland, Oreg. 97219-1715

[21] Appl. No.: 3,555

[22] Filed: Jan. 13, 1993

[51] Int. Cl.[6] ..... G04C 17/02

[52] U.S. Cl. ..... 368/240; 368/223; 368/228; 368/241

[58] Field of Search ..... 368/223, 239, 240

[56] References Cited

U.S. PATENT DOCUMENTS

| | | | |
|---|---|---|---|
| 3,003,305 | 10/1961 | Goldman | 368/240 |
| 3,516,242 | 6/1970 | Lehvoc | 368/223 |
| 4,257,115 | 3/1981 | Hatuse et al. | 368/69 |
| 4,659,232 | 4/1987 | Coster et al. | 368/223 |
| 5,199,099 | 3/1993 | Svast | 368/223 |

FOREIGN PATENT DOCUMENTS 2072896 10/1981 United Kingdom .

*Primary Examiner*—Bernard Roskoski
*Attorney, Agent, or Firm*—Klarquist Sparkman Campbell Leigh & Whinston

[57] ABSTRACT

A timepiece combines benefits of analog and digital displays in a format that is both easy to read and precise. The face of the timepiece includes a plurality of selectably displayable LCD numbers spaced about its periphery. Driving circuitry activates certain of the numbers to provide digital readouts of the hour and the minute along the periphery of the face at the angular positions conventionally corresponding thereto. Simulated analog hands can be provided as well. At 3:37, for example, the numbers 3 and 37 are activated on the periphery of the timepiece off the ends of the simulated hour and minute hands, respectively. The angular positioning of the activated peripheral numbers provides a readily discerned spatial impression of time; the numerals themselves provide digital accuracy.

3 Claims, 1 Drawing Sheet

FIG. 1
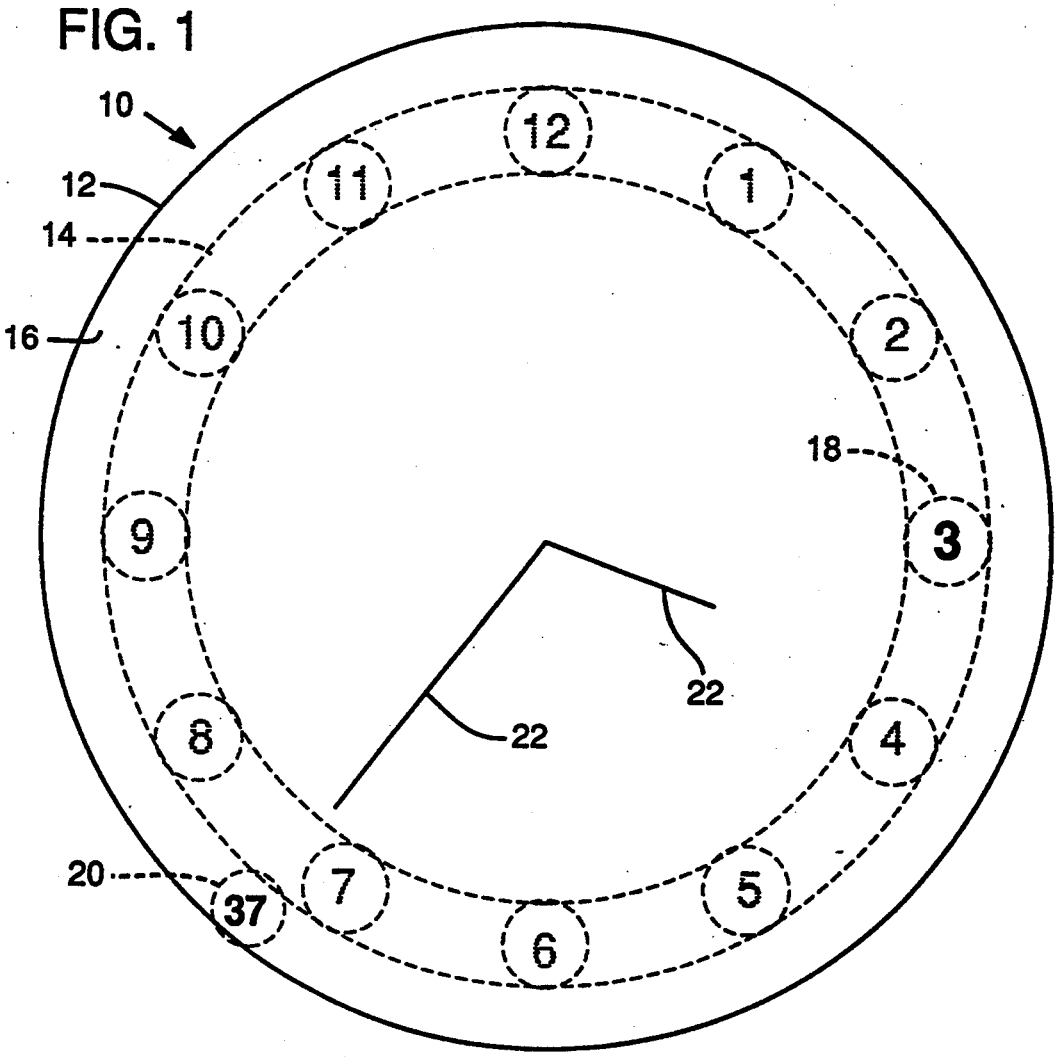
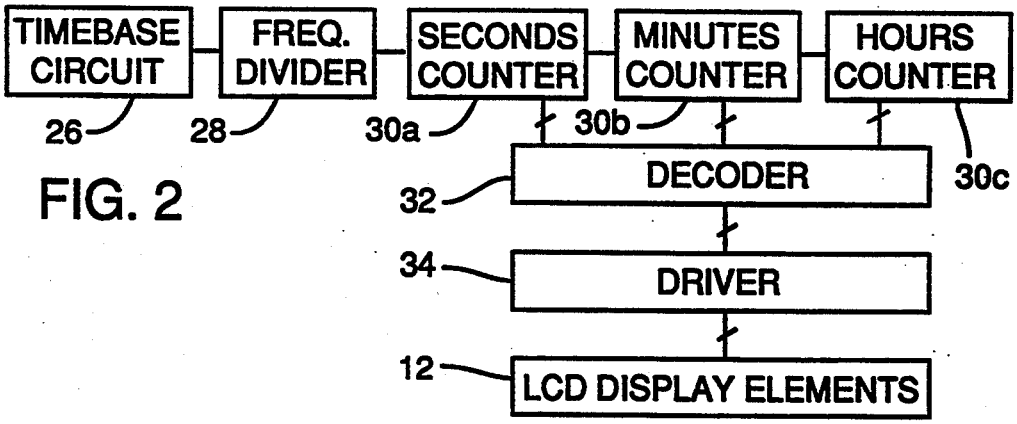
FIG. 2

SPATIAL/DIGITAL TIMEPIECE

FIELD OF THE INVENTION

The present invention relates to timepieces, and more particularly relates to a novel method and apparatus for displaying time on a timepiece.

BACKGROUND AND SUMMARY OF THE INVENTION

Existing timepieces (watches, clocks, stopwatches, etc.) generally provide a visual indication of time in one of two ways. The first, commonly called "analog," uses one or more radially extending hands to indicate hours, minutes and/or seconds. Hour numbers, tic marks or other indicia are often arrayed about the periphery of the timepiece to aid in reading the analog display.

The second technique for displaying time is commonly called "digital" and provides a direct numeric readout of the time. This technique is most commonly practiced with liquid crystal display (LCD) technology.

Various modifications and hybrids of the above two techniques are known. In one, the hands of an analog display are simulated by radially extending LCD lines which are selectively operated to provide an appearance like that of conventional mechanical hands. Examples of this arrangement are shown in U.S. Pat. Nos. 3,959,963, 4,212,159, 4,310,909, 4,355,381, 4,382,697 and 4,385,842.

In other timepieces, a digital time display is used in association with mechanical analog hands. Such timepieces are shown, for example, in U.S. Pat. Nos. 4,247,930, 4,236,240, 4,264,970, 4,413,915, 4,436,435 and 4,555,184.

Still other variations are known. U.S. Pat. Nos. 4,312,056 and 4,435,046, for example, disclose analog timepieces equipped with LCD tics about the perimeter of the display. These tics are operated to provide a sweep-second hand-like display of seconds as they elapse. The former patent additionally contemplates that certain of the tics can serve as markers to indicate which time zone is being displayed in an associated digital display.

While the foregoing timepieces are well suited for some applications, they are ill-suited for others. Purely analog displays, for example, are well suited for providing quick, distinctive geometrical impressions of time, but are ill-suited for providing precise readings. Purely digital displays are precise, but lack visual clues permitting easy reading. Combination displays, in theory, combine the best features of both, but in practice are often cluttered and difficult to use.

In accordance with the present invention, the drawbacks associated with existing timepieces are addressed in a manner that provides accuracy and ease of use. In a preferred embodiment, the timepiece of the present invention includes a plurality of selectably displayable LCD numbers spaced about the periphery of its face. Driving circuitry activates the display to provide digital readouts of the hour and the minute at the angular positions conventionally corresponding thereto. Simulated analog hands can be provided as well. At 3:37, for example, the numbers 3 and 37 are activated on the periphery of the timepiece off the ends of the simulated hour and minute hands, respectively. The angular positioning of the activated peripheral numbers provides a readily discerned spatial impression of time; the numerals themselves provide digital accuracy. Timepieces according to the present invention thus combine the advantages of analog and digital displays in a format that detracts from neither.

The foregoing and additional features and advantages of the present invention will be more readily apparent from the following detailed description, which proceeds with reference to the accompanying drawings.

BRIEF DESCRIPTION OF THE DRAWINGS

FIG. 1 shows the face of a timepiece according to a preferred embodiment of the present invention.

FIG. 2 shows an electrical block diagram of the timepiece of FIG. 1.

DETAILED DESCRIPTION

To provide a comprehensive disclosure without unduly lengthening this specification, applicant incorporates by reference the disclosures of the patents noted in the Background section and in the following discussion.

For expository convenience, the following discussion focuses on a single application of the present technology, namely a display for a wristwatch. It should be recognized, however, that the invention finds utility in every application where analog or digital displays of time (or time-related data) have previously been used.

Referring to FIGS. 1 and 2, a watch 10 according to a preferred embodiment of the present invention includes a face 12 having two concentric peripheral regions 14, 16 thereon. The first peripheral region 14 includes a plurality of hour-related LCD numeric indicia 18. The second peripheral region 16 includes a plurality of minute-related LCD digital indicia 20. The face further includes a plurality of radial LCD elements 22.

Included in the watch is circuitry 24 that includes a timebase circuit 26, a frequency divider 28, a series of second, minute and hour counters 30*a*, 30*b*, 30*c*, a decoder circuit 32, and an LCD driver circuit 34. Power is provided by a battery (not shown). The timebase circuit 26 provides an output clock signal of known frequency. The frequency divider 28 divides the frequency of the output clock signal down to a lower value, typically 1 Hertz. This signal, in turn, is provided to a series of cascaded counters 30, one each for seconds, minutes and hours. Output signals from the counters 30 are provided to a decoder 32. The output from the decoder 32 is coupled to the LCD driving circuit 34, which activates selected ones of the display elements depending on the time data.

In operation, the foregoing circuitry 24 cooperates to provide a spatial-digital display of time by displaying one hour LCD indicia 18 and one minute LCD indicia 20. The remaining display elements are left inactivated, and are thus visually imperceptible on the watch face. (These remaining display elements are shown in dashed form in FIG. 1 for purposes of illustration.) In the illustrated embodiment, a simulated analog display is also provided by selective operation of radial display elements 22 by circuitry 24.

In the illustrated embodiment, the display comprises a matrix array of pixel elements. These elements are activated in desired patterns by the decoder/driver circuitry to provide the numeric indicia (and, if desired, the simulated analog hands), in much the same manner as characters are displayed on conventional computer monitors. One advantage of a matrix-based display is that sequential minute indicia can be spaced arbitrarily closely about the periphery of the face, utilizing some of the same pixels for different numerals.

The foregoing circuitry is largely conventional and is within the capabilities of those of ordinary skill in the art. In addition to the other patents cited herein, illustrative LCD driving circuits are shown in U.S. Pat. Nos. 4,255,804, 4,110,967, 5,103,218, 5,066,945, 4,845,473, 4,769,639, 4,764,766, 4,746,915, 4,694,349, 4,679,043, 4,645,303, 4,626,841, 4,602,292, 4,537,471, 4,532,506, 4,465,999, 4,356,483, 4,300,137, 4,859,998, 5,017,914 and 5,157,386.

ALTERNATIVE EMBODIMENTS

The foregoing has described the presently preferred embodiment. However, numerous variations fall within the scope of applicant's invention. A few of these variations are noted below.

There are many techniques by which numeric indicia corresponding to the present time can be distinguished from other indicia on the face of a watch. In the embodiment discussed above, this was achieved by simply not displaying the un-used indicia. In other embodiments, the desired indicia can be distinguished by means including color, brightness and size.

Color display technology is a well developed field and includes, in the LCD field, both "TFT" active displays and passive displays. TFT watch displays are disclosed, by way of example, in U.S. Pat. Nos. 5,017,914 and 5,157,386. Passive color displays include filter-, birefringence- and dye-based approached. U.S. Pat. No. 4,716,403 shows a filter-based passive color display incorporated in a watch. Birefringent passive displays are detailed in U.S. Pat. Nos. 4,917,465 and 5,050,965.

The desired indicia can also be visually distinguished by their relative brightness. In LCD displays, methods for controlling brightness ("gray scaling") are well known. The most rudimentary simply involve controlling the duty cycle of the signal driving the LCD. That is, means can be provided for dimming all of the indicia except one for the hour indicia and one for the minute indicia.

The size of an indicia can be changed by choosing a different, larger set of pixels to represent a given indicia.

The foregoing embodiment, with its matrix-based display, is well suited to displaying a variety of different indicia. Further, the font in which the indicia are displayed can be tailored to the user's desire. For example, a user may select one font featuring large, easy-to-read numerals for sport/recreational use, and another font featuring finer detailing for more formal use. The user may likewise choose between Arabic and Roman portrayal of the digital indicia. In an embodiment featuring this capability, the display driver circuitry has a font display mode in which its repertoire of fonts is shown on the display, and from which the user can select the font desired.

In other embodiments, a dedicated, static display can be employed in place of, or in combination with, the matrix-type display discussed above. In such a static display, each indicia is formed by one or more appropriately shaped regions of liquid crystal material. These regions are then selectively operated by corresponding drive signals from the drive circuitry 34. Separate liquid crystal indicia are thus provided for each of the 12 hours, and each of the minute indicia.

In timepieces utilizing dedicated LCD indicia according to the foregoing variation, space constraints often preclude use of 60 minute indicia. Accordingly, minute indicia can be provided at 5- or 2-minute intervals.

In certain fields, such as health care and aviation, it is desirable to provide a display of seconds, as well as hours and minutes. Such a display can be provided by a third concentric ring in which second-related numeric indicia are displayed. In other embodiments, a conventional digital "seconds" display is provided on the watch face, such as at the center, and desirably can be turned on or off as needs dictate. In still other embodiments, radial elements, such as elements 22, can be operated to emulate a mechanical sweep-second hand.

In health care and aviation, it is also desirable to provide time data in a 24-hour format, instead of the conventional 12-hour format. Watches according to the present invention can be equipped to selectably provide this feature. (In addition to the additional hour indicia 13–23, it will be recognized that this change can be effected by changing the modulo-12 hour counter 30*c* to a modulo-24 counter.)

From the foregoing, it will be recognized that the present invention advantageously combines the benefits of analog and digital time displays, while avoiding the associated drawbacks.

Having described and illustrated the principles of my invention with reference to a preferred embodiment and several variations thereof, it will be apparent that the invention can be further modified in arrangement and detail without departing from such principles. For example, while the invention has been illustrated with reference to timepieces that display the current time, it will be recognized that the invention can be utilized to display a variety of other time-related data. Stopwatches and timers are examples. Similarly, while the invention has been illustrated with reference to a face that is round in shape, it will be recognized that a variety of other face configurations can be used. Indeed, embodiments of the invention having non-round face configurations hold promise in specialty applications, including fine and abstract art. Still further, while the invention has been illustrated with particular reference to LCD display technology, it will be recognized that the invention can be practiced with a variety of other display technologies.

In view of the wide variety of embodiments to which the principles of my invention can be applied, it should be apparent that the detailed embodiments are illustrative only and should not be taken as limiting the scope of my invention. Rather, I claim as my invention all such modifications as may come within the scope and spirit of the following claims and equivalents thereto.

I claim:

1. An apparatus for providing an improved display of time including:

a face having first and second sets of time-related indicia angularly disposed about the periphery thereof, the first set including a plurality of hour-related indicia, the second set including a plurality of minute-related indica;

driving means for operating said indicia so that one of each set of indicia is visually distinguishable from the others in said set of indicia, the driving means including means for dimming all of the indicia except one from the first set and one from the second set;

at least the minute-related indicia having the form of a set of digital numeric representations;

the minute-related indicia being disposed about the periphery at angular positions defined by the minute to which each corresponds;

said indicia taking the form of liquid crystal display elements;

analog hand means providing an analog time-related display, said analog hand means including a plurality of display elements which can be selectively operated to emulate a mechanical hour hand, and a plurality of display elements which can be selectively operated to emulate a mechanical minute hand;

the driving means further including:

means for operating the minute-related indicia at a plurality of successive clockwise positions about the periphery of the face once each hour;

means providing a reference clock signal;

means for processing the reference clock signal to provide at least one digital clock signal;

counter means responsive to the at least one digital clock signal for producing digital signals corresponding to hour and minute data;

LCD driver circuitry for controlling the LCD display in accordance with the digital signals corresponding to the hour and minute data;

wherein a display featuring spatial, as well as digital, representation of time is achieved.

2. An apparatus for providing an improved display of time including:

a face having first and second sets of time-related indicia angularly disposed about the periphery thereof, the first set including a plurality of hour-related indicia, the second set including a plurality of minute-related indica;

driving means for operating said indicia so that one of each set of indicia is visually distinguishable from the others in said set of indicia, the driving means including means for dimming all of the indicia except one from the first set and one from the second set;

at least the minute-related indicia having the form of a set of digital numeric representations;

the minute-related indicia being disposed about the periphery at angular positions defined by the minute to which each corresponds;

analog hand means providing an analog time-related display, said analog hand means including a plurality of display elements which can be selectively operated to emulate a mechanical hour hand, and a plurality of display elements which can be selectively operated to emulate a mechanical minute hand;

the driving means further including:

means for operating the minute-related indicia at a plurality of successive clockwise positions about the periphery of the face once each hour;

means providing a reference clock signal;

means for processing the reference clock signal to provide at least one digital clock signal;

counter means responsive to the at least one digital clock signal for producing digital signals corresponding to hour and minute data;

driver circuitry for controlling the display indicia in accordance with the digital signals corresponding to the hour and minute data;

wherein a display featuring spatial, as well as digital, representation of time is achieved.

3. An apparatus for providing an improved display of time including:

a face having first and second sets of time-related indicia angularly disposed about the periphery thereof, the first set including a plurality of hour-related indicia, the second set including a plurality of minute-related indica;

driving means for operating said indicia so that one of each set of indicia is visually distinguishable from the others in said set of indicia, the driving means including means for dimming all of the indicia except one from the first set and one from the second set;

at least the minute-related indicia having the form of a set of digital numeric representations;

the minute-related indicia being disposed about the periphery at angular positions defined by the minute to which each corresponds;

analog hand means providing an analog time-related display, said analog hand means including a plurality of display elements which can be selectively operated to emulate a mechanical hour hand, and a plurality of display elements which can be selectively operated to emulate a mechanical minute hand;

the driving means further including:

means for operating the minute-related indicia at a plurality of successive clockwise positions about the periphery of the face once each hour;

driver circuitry for controlling the display indicia in accordance with digital signals corresponding to the hour and minute data;

wherein a display featuring spatial, as well as digital, representation of time is achieved.

* * * * *